United States Patent [19]

Beshore

[11] Patent Number: 4,625,685

[45] Date of Patent: Dec. 2, 1986

[54] MACHINE WITH DOUBLE ACTING BOX PISTON

[76] Inventor: Craig S. Beshore, 753 Puma Canyon La., Glendora, Calif. 91740

[21] Appl. No.: 667,416

[22] Filed: Nov. 1, 1984

[51] Int. Cl.[4] ..... F02B 59/00

[52] U.S. Cl. ..... 123/50 R; 123/64; 92/177

[58] Field of Search ..... 123/50, 61–64; 92/177

[56] References Cited

U.S. PATENT DOCUMENTS

| | | | |
|---|---|---|---|
| 1,329,514 | 2/1920 | Dusoevoir et al. | 123/50 R |
| 2,067,171 | 1/1937 | Beard | 123/64 |
| 2,863,426 | 12/1958 | Summerlin | 123/50 R |
| 3,181,516 | 5/1965 | Peterson | 123/50 R |
| 3,910,242 | 10/1975 | Hom et al. | 92/177 |
| 4,261,303 | 4/1981 | Ramsey | 123/50 R |

*Primary Examiner*—Craig R. Feinberg
*Attorney, Agent, or Firm*—Boniard I. Brown

[57] ABSTRACT

The machine is an engine or pump with a box shaped piston positioned between two stationary sidewalls. Opposite inward ends and inwardly facing moving sidewalls of the piston act with the two stationary case sidewalls and a block-shaped central head to define a pair of working chambers. The piston moves as restrained by a crankshaft to extract or add energy to the working chambers. Force is transferred between the piston and the crankshaft by means of a slide block on the crankshaft and the inner surface of a pair of parallel walls connected to the box shaped piston. Through the use of suitable cams and valves, four-cycle, two-cylinder equivalent engines and two-cycle, one-cylinder equivalent engines can be produced per piston. The planar walls of the machine maximize displacement while reducing mechanical stress and allowing use of heat resistant coating material, such as ceramics for thermal protection so that radiantly cooling rather than separate fluid or gaseous cooling systems can be used.

20 Claims, 9 Drawing Figures

57
56
58
55
26
60
78
62
54
46
74
34
24
78
90
44
50
52
64
27
48
86
34
27
22

FIG-7
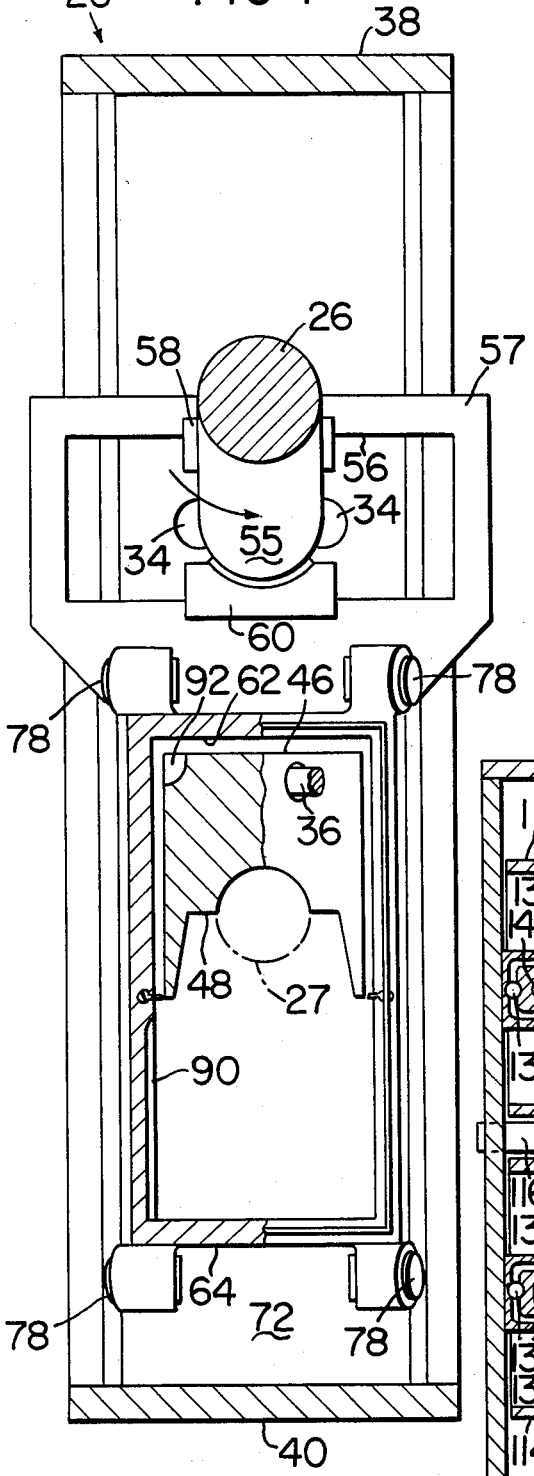
FIG-8
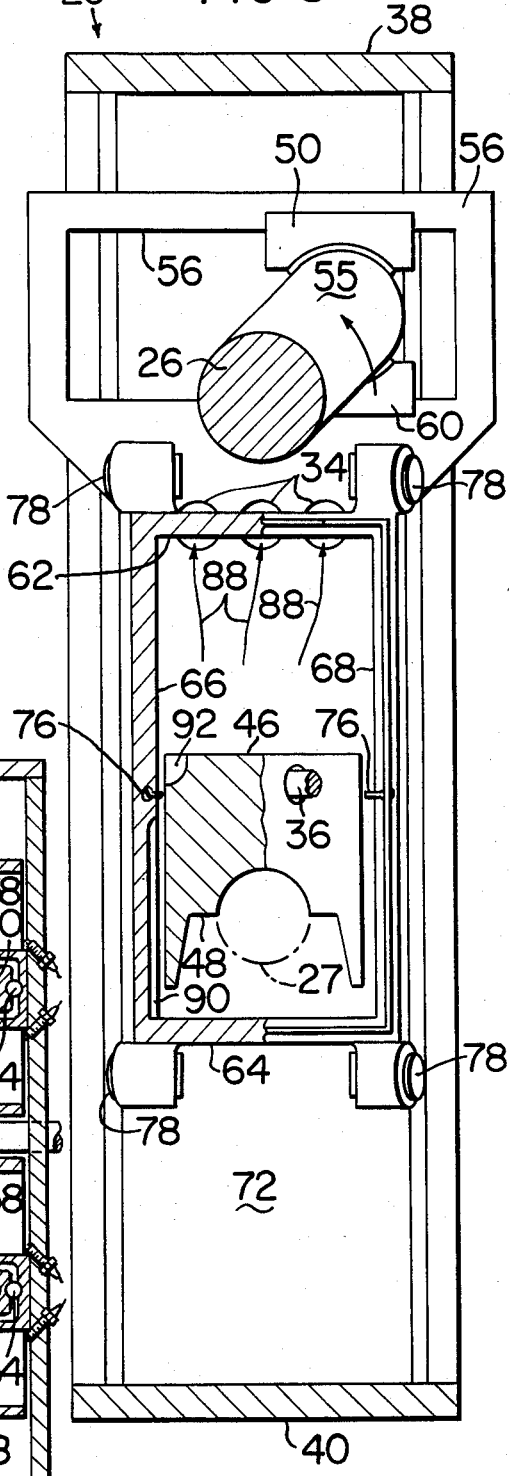
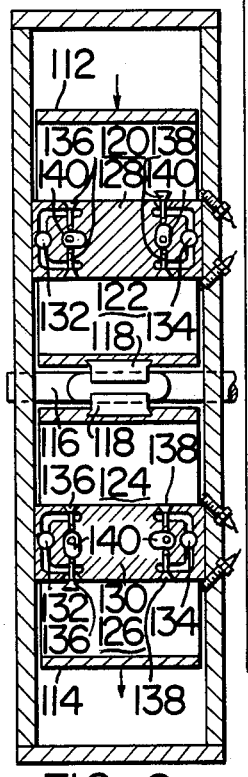
FIG-9

MACHINE WITH DOUBLE ACTING BOX PISTON

BACKGROUND OF THE INVENTION

Reciprocating engines and pumps heretofore have been constructed with cylindrical pistons riding in fixed cylinder walls connected to a crankshaft by relatively long connecting rods. Due to the cylindrical nature of their construction and the space-taking connecting rods, none of these devices can provide a machine which can process a maximum amount of air for its size and weight and yet be efficient. It has heretofore been known that cube or box-shaped structures are very efficient for a given volume, but heretofore this principle has not been effectively employed in engine design. Also, prior art engines and pumps are mechanically stressed during operation to such an extent that ceramic or other heat resistant materials cannot be used successfully therewith. Therefore, they must be operated at relatively low temperatures which result in low thermal efficiencies.

U.S. Pat. No. 4,586,881 of the inventor of the present application, entitled "Machine Having Integral Piston and Cylinder Wall Sections", relates to an efficient engine utilizing an H-shaped piston, preferably having planar walls, which is structurally dissimilar from the present invention.

SUMMARY OF THE INVENTION

A machine is provided which can be used as a two-cycle or a four-cycle diesel or gasoline engine or a pump. In its basic form, it employs two working chambers inside a double acting piston having a rectangular cross-section. In elevation, the double acting piston is generally box-shaped with opposite open sides. A stationary central block-shaped head is positioned within the piston and is connected to opposite stationary sidewalls which seal the opposite open sides thereof. The box-shaped piston is reciprocated by a crankshaft passing through and sliding transversely in a slot connected thereto usually adjacent one end thereof. The piston is supported for linear reciprocating movement against the sides of the case of the machine by suitable bearings. The head can include valves with suitable intake and exhaust ports, spark plugs, or fuel injectors when four-cycle machines are constructed. Otherwise, when two-cycle machines are constructed, suitable bypass ports are provided about the head so that one working chamber on one side of the head acts as a pre-compression chamber and the other working chamber acts as a conventional two-cycle combustion chamber. A pair of box-shaped pistons can be included on opposite sides of the crankshaft so that four, four cycle working chambers can operate off of one throw of the crank or two, two cycle working chambers can operate off a single throw.

Since the working chambers are formed with planar walls which can be supported against flexure, the surfaces thereof can be treated with heat resistant material. This allows the machines to be run at much higher temperatures than is common for prior art engines and pumps so that radiant cooling becomes possible. This also makes the machines more thermodynamically efficient as large quantities of waste heat need not be extracted by a cooling system to maintain low operating temperatures; instead, more heat is converted into work within the machine.

It is therefore an object of the present invention to provide an engine or pump having rectangular combustion or compression cylinders which can accommodate most common engine cycles or operations.

Another object is to provide a mechanical thermodynamic conversion device which can be constructed to operate at high temperatures.

Another object is to provide a compact engine adapted to accommodate and withstand high pressures.

These and other objects and advantages will become apparent to those skilled in the art after considering the following detailed specification and drawings wherein:

BRIEF DESCRIPTION OF THE DRAWINGS

FIG. 7 is an elevational cross-sectional view of the engine of FIGS. 1 through 3 in the equivalent of the top dead center position;

FIG. 8 is an elevational cross-sectional view of the engine of FIGS. 1 through 3 commencing its exhaust cycle; and FIG. 9 is a diagrammatic side view of a four cylinder equivalent, twin piston, four-cycle machine constructed according to the present invention.

DETAILED DESCRIPTION OF THE SHOWN EMBODIMENTS

Figure 1:
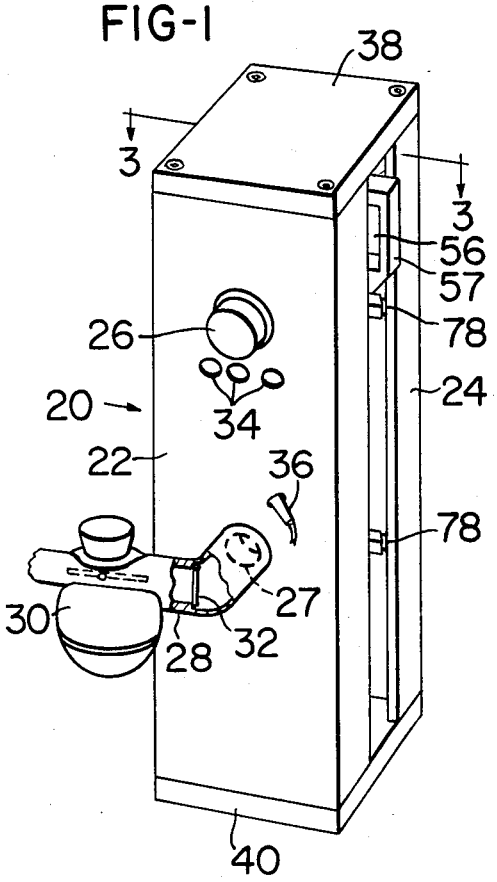
FIG. 1 is a perspective view of an engine constructed according to the present invention.

Referring to the drawings more particularly by reference numbers, number 20 in FIG. 1 refers to a single piston two-cycle engine constructed according to the present invention. As shown, the engine 20 includes opposite side split case members 22 and 24 across which a crankshaft 26 extends to provide the power output of the engine 20. The case member 22 includes an intake manifold 28 which connects a suitable carburetor 30 to the engine 20 through a one way flapper valve 32 which prevents flow except from the carburetor 30 through the intake manifold 28 to the engine 20. The flapper valve 32 is shown for illustrative purposes only and may be replaced by any number of the known valves including those that are timed mechanically to the crankshaft 26. The case members 22 and 24 also include exhaust ports 34 and ignition means, such as the spark plug 36. The upper and lower portions of the case members 22 and 24 are held together by end covers 38 and 40.

Figure 4:
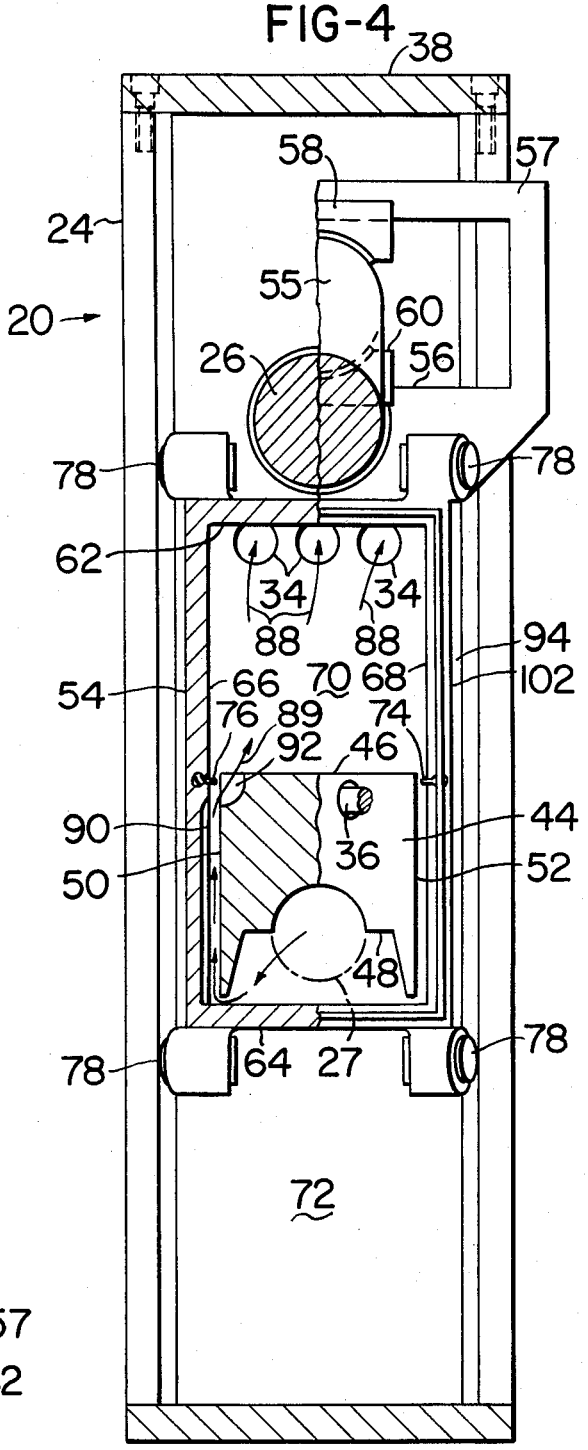
FIG. 4 is an elevational cross-sectional view of the engine of FIGS. 1 through 3 in the equivalent of the bottom dead center position.
Figure 3:
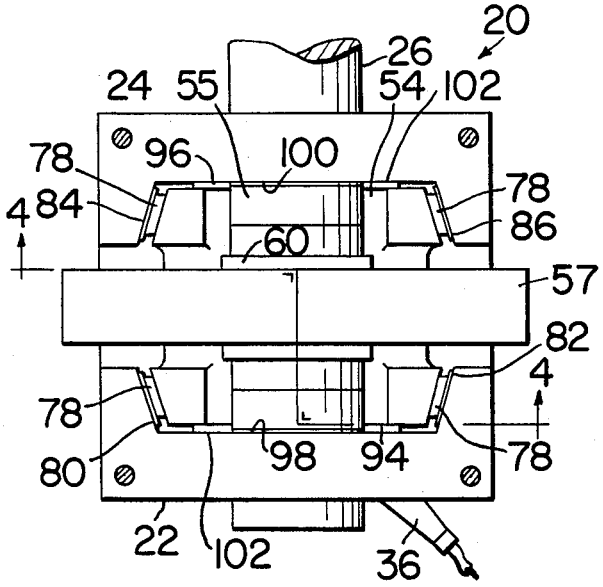
FIG. 3 is a top cross-sectional view taken at line 3—3 of FIG. 1.
Figure 2:
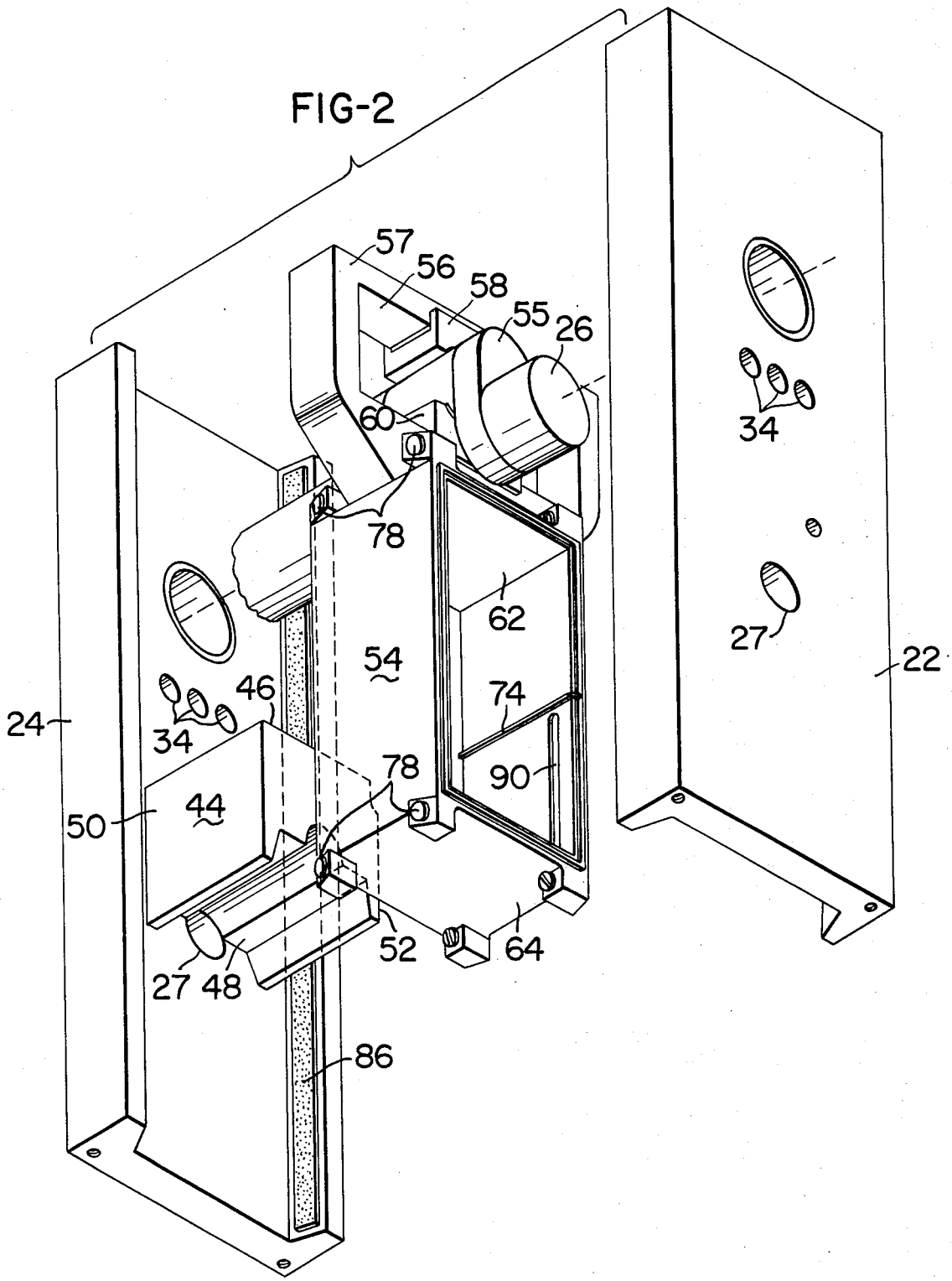
FIG. 2 is an exploded perspective view of the engine of FIG. 1.

The basic configuration of the engine 20 is more clearly seen from the views of FIGS. 2, 3 and 4. A central head block 44 is fixedly connected between the two case members 22 and 24 at a spaced location from the crankshaft 26. With the case members 22 and 24 fixedly connected to and mating with two sides of the head block 44, the remaining head side 46, under head side 48, and sliding sides 50 and 52 are surrounded by a rectangular box-shaped piston 54 which is connected for movement to the arm 55 of the crankshaft 26 by means of a slot 56 formed in an extension 57 of the piston 54 and a pair of slider blocks 58 and 60. Rotation of the crankshaft 26 causes the piston 54 to move with respect to the head block 44 and the case sides 22 and 24 so that in the two-cycle machine described, one end surface 62 of the piston 54 acts as the top thereof while the opposite end surface 64 operates as its bottom. The sidewalls 66 and 68 of the piston 54 extend between the surfaces 62 and 64 act as the skirts of the piston 54 as well as portions of a pair of working chambers 70 and 72 which are defined within the piston 54 by the head block 44 and the case members 22 and 24. Seal strips 74 and 76 mounted midway in the sidewalls 66 and 68 of the piston 54 divide the two working chambers 70 and 72. Eight adjustable bearing pads 78 are included at the outer corners of the piston 54. The pads 78 adjust parallel to each other but are angled at about 15° and run on bearing strips 80 and 82 mounted on the case member 22 and bearing strips 84 and 86 mounted on the case member 24. The pads 78 are adjusted so that the piston 54 floats from the case members 22 and 24. This lack of contact allows high temperature materials such as ceramics to be used without fear that contact stresses will cause them to crack. Suitable materials for the pads 78 include hot pressed silicone nitride which can run unlubricated in most cases. It should be noted that the pads are not exposed to combustion and therefor run much cooler than the cylinder walls and pistons of conventional engines where the walls and pistons form the contacting bearing surfaces.

Looking at the operation of the engine 20 in FIG. 4, the engine is in the midst of its exhaust and scavenging cycle. That is, exhaust 88 is flowing out of the ports 34 while a scavenging flow of air and fuel 89 in pre-compressed chamber 72 is flowing into working chamber 70 by means of a bypass 90 formed in the side 66 of the piston 54. The flow 89 is directed in the proper direction by a cutout 92 formed in the head side 46 of the head block 44 and shaped for that purpose.

Figure 5:
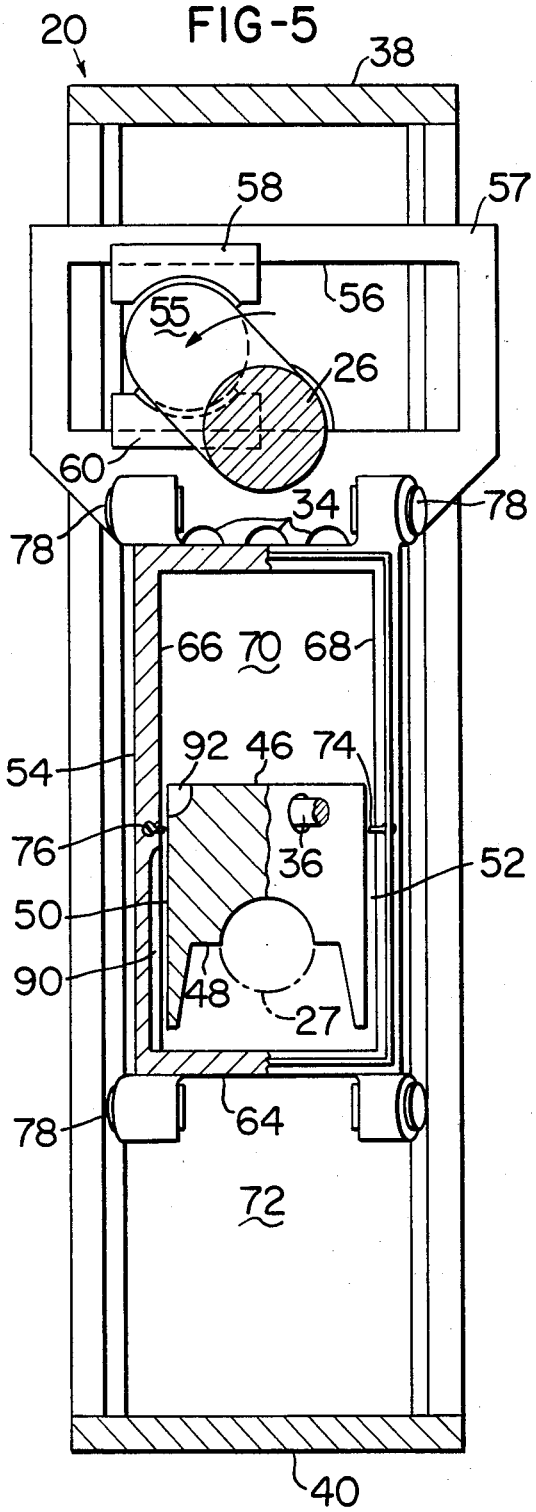
FIG. 5 is an elevational cross-sectional view of the engine of FIGS. 1 through 3 commencing its compression cycle.
Figure 6:
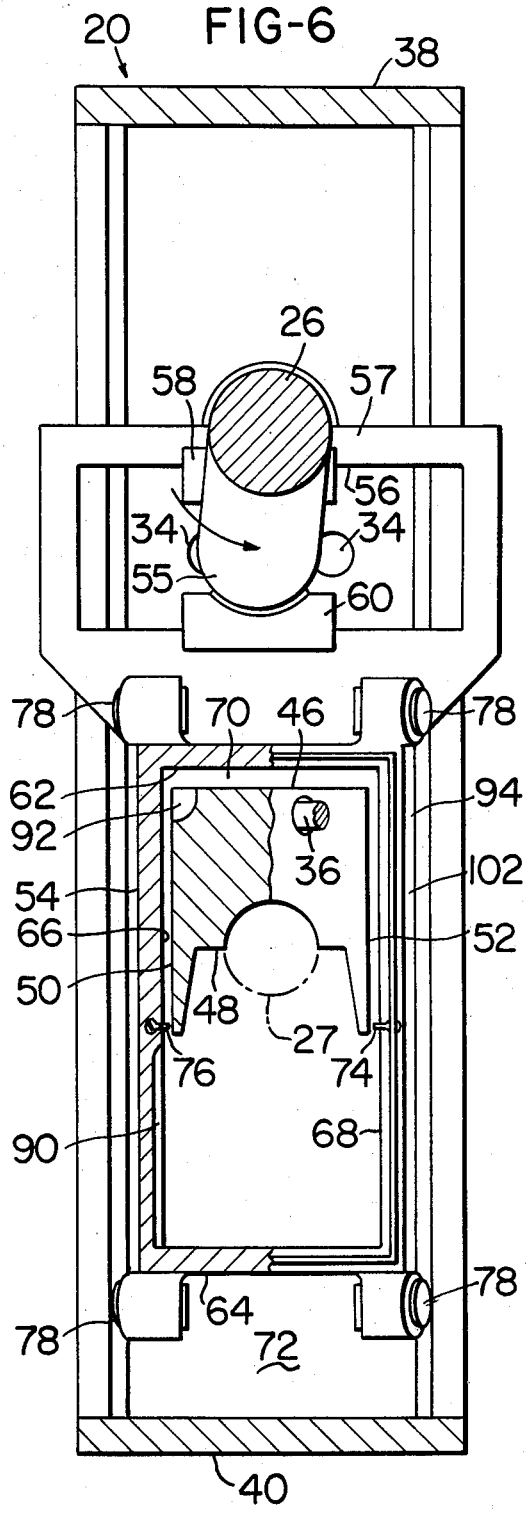
FIG. 6 is an elevational cross-sectional view of the engine of FIGS. 1 through 3 at ignition.

As the crankshaft 26 turns it moves the piston 54 downwardly until, as shown in FIG. 5, both the exhaust ports 34 and the bypass 90 are closed so that the compression of the fuel air flow 89 can start to occur in working chamber 70 while a partial vacuum is formed in working chamber 72 drawing fuel and air thereinto from the carburetor 30 past the flapper valve 32. As shown in FIG. 6, when the crankshaft 26 has moved the piston 54 close to what would normally be called top dead center, ignition occurs by means of the spark plug 36. The piston 54, thereafter goes through top dead center, as shown in FIG. 7, and the expansion of the burning gasses causes the piston 54 to move upwardly, as shown in FIG. 8, the energy of the expansion being extracted out through the crankshaft 26 until the exhaust ports 34 are uncovered, whereupon the commencement of the flow of exhaust 88 out of the ports 34 commences. It should be noted that the positioning of the ports 34 is such that exhaust flow 88 commences prior to scavenging flow from the working chamber 72 wherein the air fuel mixture has been pre-compressed by the movement of the piston 54 upwardly. Thereafter, the engine 20 reaches the condition shown in FIG. 3 and the cycle continues. If the working chambers 72 and 70 are disproportionate in size, that is, working chamber 72 being larger than working chamber 70, the engine 20 can be operated as two-stage air pump with energy being supplied thereto through the crankshaft 26.

In the configuration shown in FIGS. 1 through 8, the piston 54 has opposite sides 94 and 96 which form sliding sealing surfaces adjacent the interior planar surfaces 98 and 100 of the case members 22 and 24, as shown in FIG. 2. Seal strips 102 as shown with respect to side 94 in FIGS. 3 through 8, are embedded in the edges thereof to assure complete sealing by contact with the interior planar surfaces 98 and 100. Since this configuration is rectangular and does not expand or contract substantially in use, the seal strips 102 may be a solid rectangular seal or may be made up of various pieces. All usually are spring-loaded outwardly to assure good sealing contact.

FIG. 9 is a diagrammatic cross-sectional view of a four-cycle, two piston, four working chamber engine 110 constructed according to the present invention. In the engine 110, box shaped pistons 112 and 114 are connected to a crankshaft 116 by means of a slotted member 118 connected therebetween. The result is four working chambers, chambers 120, 122, 124 and 126. In each piston 112 and 114, the working chambers 120 and 122 or 124 and 126, respectively, are separated by head blocks 128 and 130. Each head block includes an intake port 132, an exhaust port 134, a pair of intake valves 136, a pair of exhaust valves 138 and suitable cam mechanisms 140 connected to the crankshaft 116 to drive the valves 136 and 138. The engine 110 is shown with the working chambers each part way through a different portion of the four-cycle. For example, since the exhaust valve into working chamber 120 is open and it is assumed that the crankshaft 116 is moving the pistons 112 and 114 downwardly, working chamber 120 is in its exhaust cycle while working chamber 122 is in the power cycle with both its intake and exhaust valves 136 and 138 closed. The working chamber 124 is in its compression cycle while working chamber 126 is in its intake cycle. Each of the working chambers cycle from intake to compression to power to exhaust, so that one working chamber is in the power cycle, one is in the exhaust, one is in the compression and one is in the intake, thus balancing the engine 110. Of course, by properly valving the working chambers and providing power to the crankshaft, the engine 110 can be operated as an air pump.

Thus there have been shown and described novel engines and compressors which fulfill all of the objects and advantages sought therefor. Many changes, alterations, modifications and other uses and applications of the subject engines and compressors will become apparent to those skilled in the art after considering this specification together with the accompanying drawings and claims. All such changes, alterations and modifications which do not depart from the spirit and scope of the invention are deemed to be covered by the invention which is limited only by the claims which follow.

What is claimed is:

1. A machine having at least a first working chamber formed by:

a machine case with:

first and second stationary sidewall surfaces facing each other, each surface of said first and second stationary sidewall including:

a pair of bearing surfaces thereon; and a first head surface extending between said first and second stationary sidewall surfaces; and a first generally box-shaped reciprocating piston having:

a first end interior surface facing said first head surface;

first and second reciprocating sidewall surfaces extending between said first and second stationary sidewall surfaces and between said first end interior surface and said first head surface to define a first working chamber;

eight corners, each corner having:

an adjustable, outwardly facing, bearing pad thereon positioned for engagement with one of said bearing surfaces; and first and second opposite rectangular side edges, said first opposite rectangular side edge facing said first stationary sidewall surface and being slightly spaced therefrom, and second opposite rectangular side edge facing said second stationary sidewall surface and being slightly spaced therefrom, said first and second opposite rectangular side edges each including:

seal means which contact said first and second stationary sidewall surfaces respectively to prevent flow thereabout.

2. The machine defined in claim 1 wherein said adjustable outwardly facing bearing pads are constructed from hot pressed silicon nitride.

3. The machine defined in claim 1 wherein said pair of bearing surfaces on each of said first and second stationary sidewall surfaces are each canted from parallel about 15°.

4. The machine defined in claim 3 wherein said bearing pads adjust inwardly and outwardly parallel to each other.

5. A machine having at least a first working chamber formed by:

a machine case with:

first and second stationary sidewall surfaces facing and spaced from each other; and a first head surface extending between said first and second stationary sidewall surfaces; and a first generally box-shaped reciprocating piston having:

a first end interior surface facing said first head surface; and first and second reciprocating sidewall surfaces spaced from each other and extending between and substantially perpendicular to said first and second stationary sidewall surfaces and at least between said first end interior surface and said first head surface so as to form oppositely spaced open sides facing said first and second stationary sidewall surfaces, edges of said first and second reciprocating sidewall surfaces being in sealed engagement with said first and second stationary sidewall surfaces so as to cover said open sides and define a first working chamber, said first end interior surface and said first and second reciprocating sidewall surfaces being fixedly connected together for common movement.

6. The machine defined in claim 5 wherein said machine case further includes:

a first head block on which said first head surface is positioned, said first head block being located within said first generally box-shaped reciprocating piston and having:

a second head surface extending between said first and second stationary sidewall surfaces formed thereon facing in an opposite direction from said first head surface, said first generally box-shaped reciprocating piston further including:

a second end interior surface facing said second head surface and toward said first end interior surface, said first and second reciprocating sidewall surfaces extending between said first and second stationary sidewall surfaces and between said second end interior surface and said second head surface to define a second working chamber and said second end interior surface being fixedly connected to said first end interior surface for common movement therewith.

7. The machine defined in claim 6 wherein said first generally box shaped reciprocating piston further includes:

first and second parallel facing slide surfaces positioned adjacent said first end interior surface thereof, said machine further including:

crankshaft means supported by said machine case and operatively connected for sliding contact to said piston at said first and second parallel facing slide surfaces.

8. The machine defined in claim 7 wherein said first head block includes:

check valve intake port means, and said first stationary sidewall surface includes:

exhaust port means positioned to be opened and closed to said first working chamber by said first end interior surface moving therepast.

9. The machine defined in claim 7 wherein said first reciprocating sidewall surface includes:

a transverse seal bearing against said first head block to separate said first and second working chambers; and a bypass passage defined therein connected to said second working chamber, said first head block first head surface having:

a cutout therein whereby said bypass passage can communicate said first and second working chambers when said first generally box shaped reciprocating piston is positioned with its first end interior surface further from said first head surface than said second end interior surface is spaced from said second head surface.

10. The machine defined in claim 7 wherein said first head block includes:

a first intake port;

a first exhaust port;

a first intake valve positioned in said first intake port to control flow therethrough; and a first exhaust valve positioned in said first exhaust port to control flow therethrough.

11. The machine defined in claim 10 further including:

valve actuating means connected between said crankshaft and said first intake and first exhaust valves to actuate said valves in synchronism with rotation of said crankshaft.

12. The machine defined in claim 11 wherein said first generally box shaped reciprocating piston includes:

first and second opposite rectangular side edges, said first opposite rectangular side edge facing said first stationary sidewall surface and said second opposite rectangular side edge facing said second stationary sidewall surface, said first and second opposite rectangular side edges each including:

seal means which contact said first and second stationary sidewall surfaces respectively to prevent flow thereabout.

13. The machine defined in claim 5 wherein said machine case further includes:

a third head surface extending between said first and second stationary sidewall surfaces; and a second generally box shaped reciprocating piston having:

a third end interior surface facing said third head surface; and third and fourth reciprocating sidewall surfaces extending between said first and second stationary sidewall surfaces and between said third end interior surface and said third head surface to define a third working chamber.

14. The machine defined in claim 13 wherein said machine case further includes:

a second head block on which said third head surface is positioned, said second head block being located within said second generally box shaped reciprocating piston and having:

a fourth head surface extending between said first and second stationary sidewall surfaces formed thereon and facing in an opposite direction from said third head surface, said second generally box shaped reciprocating piston further including:

a fourth end interior surface facing said fourth head surface and toward said third end interior surface, said third and fourth reciprocating sidewall surfaces extending between said first and second stationary sidewall surfaces and between said fourth end interior surface and said fourth head surface to define a fourth working chamber.

15. The machine defined in claim 14 wherein said second generally box shaped reciprocating piston is connected to said first generally box shaped reciprocating piston and further includes:

third and fourth parallel facing slide surfaces positioned adjacent said third end interior surface thereof.

16. The machine defined in claim 15 wherein said second head block includes:

check valve intake port means, and said third stationary sidewall surface includes:

exhaust port means positioned to be opened and closed to said third working chamber by said third end interior surface moving therepast.

17. The machine defined in claim 15 wherein said third reciprocating sidewall surface includes:

a transverse seal bearing against said second head block to separate said third and fourth working chambers; and a bypass passage defined therein connected to said fourth working chamber, said second head block third head surface having:

a cutout therein whereby said bypass passage can communicate said third and fourth working chambers when said second generally box shaped reciprocating piston is positioned with its third end interior surface further from said third head surface than said fourth end interior surface is spaced from said fourth head surface.

18. The machine defined in claim 15 wherein said second head block includes:

a second intake port;

a second exhaust port;

a second intake valve positioned in said second intake port to control flow therethrough; and a second exhaust valve positioned in said second exhaust port to control flow therethrough.

19. The machine defined in claim 18 wherein said valve actuating means are connected between said crankshaft and said second intake and second exhaust valves of said second head block to actuate said valves in synchronism with rotation of said crankshaft.

20. The machine defined in claim 19 wherein said second generally box shaped reciprocating piston includes:

first and second opposite rectangular side edges, said first opposite rectangular side edge facing said first stationary sidewall surface and said second opposite rectangular side edge facing said second stationary sidewall surface, said first and second opposite rectangular side edges each including:

seal means which contact said first and second stationary sidewall surfaces respectively to prevent flow thereabout.

* * * * *